United States Patent [19]

Sussman

[11] Patent Number: 4,807,760

[45] Date of Patent: Feb. 28, 1989

[54] COMPARTMENTALIZED TRAY FOR COSMETICS AND SUNDRIES

[76] Inventor: Howard Sussman, 3101 NW. 25th Ave., Pompano Beach, Fla. 33069

[21] Appl. No.: 938,398

[22] Filed: Dec. 5, 1986

[51] Int. Cl.[4] ..... B65D 69/00

[52] U.S. Cl. ..... 206/581; 206/371; 206/557; 206/561; 220/20; 220/22

[58] Field of Search ..... 206/371, 557, 558, 561, 206/566, 581, 576; 220/20, 22, 22.5; 312/117, 118, 107; D7/70

[56] References Cited

U.S. PATENT DOCUMENTS

| | | | |
|---|---|---|---|
| 869,614 | 10/1907 | Bennett | 206/561 X |
| 892,969 | 7/1908 | Wilson | 220/22 |
| 931,826 | 8/1909 | Werstad | 220/20 X |
| 1,081,674 | 12/1913 | Klenk | 220/20 X |
| 1,206,276 | 11/1916 | Wallach | 206/581 X |
| 4,390,217 | 6/1983 | Wagner | 206/566 X |
| 4,436,215 | 3/1984 | Kleinhart et al. | 220/22 X |
| 4,448,307 | 5/1984 | Roggenkamp | 220/20 X |
| 4,577,773 | 3/1986 | Bitel | 206/561 X |

*Primary Examiner*—David T. Fidei

[57] ABSTRACT

A plastic tray-like article of manufacture having a transverse central wall delineating a rear storage section with deep compartments for storing larger sized items and a front section with shallower compartments for smaller items, and wherein the bottom of the central wall serves as a stop for drawers disposed for sliding movement beneath the front section compartments.

2 Claims, 2 Drawing Sheets

COMPARTMENTALIZED TRAY FOR COSMETICS AND SUNDRIES

The present invention relates generally to a storage tray for cosmetics and like sundries, and more particularly to a storage tray construction that despite its simplicity provides compartments of different sizes and shapes to accommodate a wide variety of cosmetic items for storage therein.

BACKGROUND OF THE INVENTION

Open compartmentalized storage trays for cosmetics or the like are, of course, well known, as exemplified by U.S. Pat. No. 4,118,084 issued on Oct. 3, 1978. To contribute to the utility of these convenience products, it is desirable that cosmetic items, whether they be tall or elongated, such as face cream or perfume bottles commonly tend to be, or smaller in height, such as lipstick tubes or face powder compacts, readily accommodated in appropriately shaped and sized storage compartments. To provide for this size and shape variation, however, complicates the construction of the tray and its manufacturing cost.

Broadly, it is an object of the present invention to provide a cosmetic item storage tray with significant variation in size and shape of its storage compartments, but which is nevertheless characterized by a simple construction overcoming the foregoing and other shortcomings of the prior art. More particularly, it is an object to provide a plastic article of manufacture storage tray having both deep and shallow storage compartments clearly delineated in the storage area thereof by a centrally located transverse wall, which additionally allows the use of sliding drawers, all as is described and illustrated in greater detail subsequently herein.

SUMMARY OF THE INVENTION

An open compartmentalized tray for storing various sized cosmetic sundries and the like demonstrating objects and advantages of the present invention includes a tray body defined by a pair of opposite sides, a bottom wall, and a rear wall, all cooperating to bound a storage area. A middle wall is arranged in spanning relation between the opposite sides and delineates the storage area into a front section and a rear section. The rear section more particularly forms a rear storage compartment for larger sized objects in that it is bounded by the full height of the rear portions of the opposite sides walls, the rear wall and the rear portion of the bottom wall. In the front section a horizontally oriented compartment bottom wall is disposed also in spanning relation between the opposite sides and so as to extend forwardly of the middle wall and as such forms a front storage compartment in a clearance position above the front portion of the bottom wall for smaller sized objects. Plural drawers are disposed beneath the front storage compartment for sliding movement between open positions extended from the tray and closed positions in abutment against the bottom portion of the middle wall, whereby the tray has compartments and drawers for storing different sized objects.

BRIEF DESCRIPTION OF THE DRAWINGS

The above description, as well as further objects, features and advantages of the present invention will be more fully appreciated by reference to the following detailed description of a presently preferred, but nonetheless illustrative embodiment in accordance with the present invention, when taken in conjunction with the accompanying drawings, wherein.

DESCRIPTION OF THE PREFERRED EMBODIMENT

Figure 1:
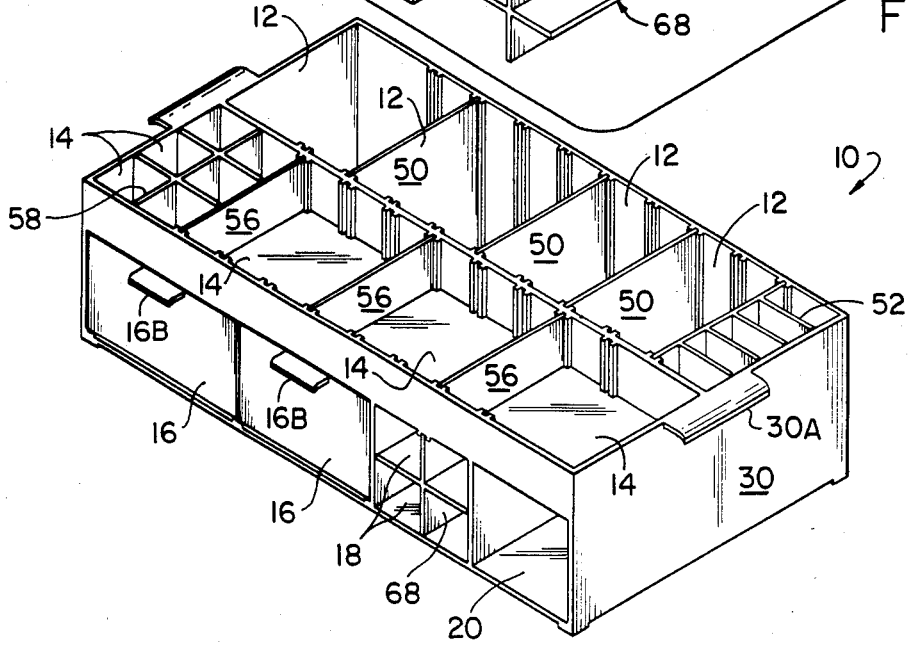
FIG. 1 is an isometric view of the inventive tray hereof in an assembled condition.

As shown in FIG. 1, the present invention is related to an open compartmentalized tray generally designated 10, which among other noteworthy features, is constructed to store cosmetic articles and other sundries of different sizes. To this end, tray 10 has rear compartments, individually and collectively designated 12, which in height are relatively deep and are, therefore, suitable for storing large cosmetic items, whereas shallower compartments, here again individually and collectively designated 14, are provided in the front and more suitable for storing smaller sized cosmetic items. That is, in practice, rear compartments 12 would be typically used for storing bottles of face cream, perfume, pancake makeup, applicator brushes, and the like, whereas the shallower front compartments 14 would typically be used for lipstick tubes, face powder compacts, nail polish and the like. In addition, as will be explained in more detail subsequently, beneath the shallower compartments 14 provision is made for sliding drawers 16, which typically would be used for cotton swabs and cotton puffs for which the drawer provides a more sterile storage condition. The space below the shallow compartments 14 to the right of the drawers 16 is left open and is used to advantage to have delineated therein additional storage spaces, as exemplified by the open compartments 18 and the compartment 20.

Figure 2:
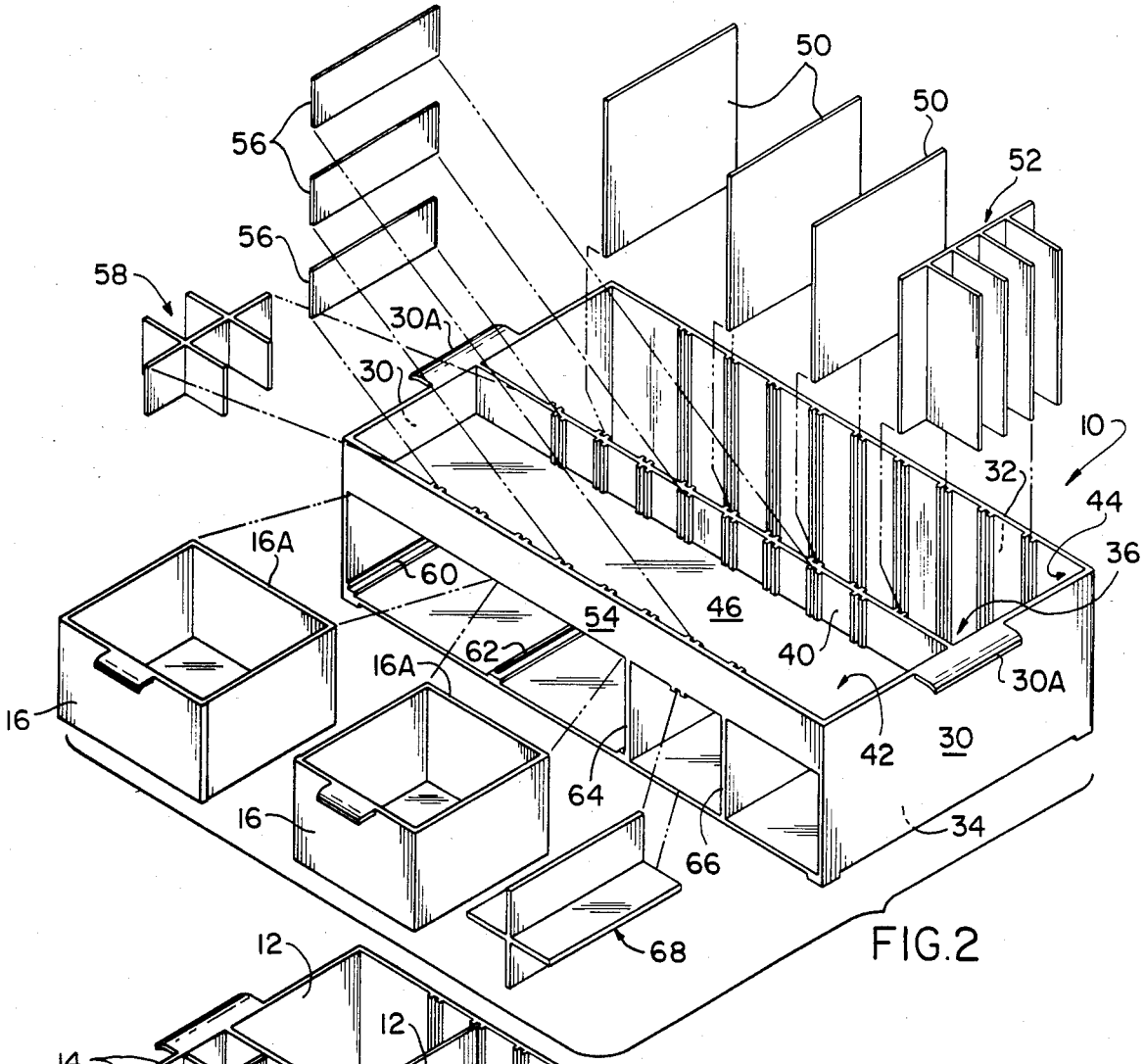
FIG. 2 is a similarly isometric view, but illustrating the tray in an unassembled condition with the component parts thereof in spaced relation to each other.

To better understand the construction of the tray 10 which readily permits it to have storage areas of various dimensions, reference should be made to FIG. 2 which illustrates the tray and all of its components in an unassembled and spaced relation to each other and with dot-dash reference lines indicating the manner in which the components are placed in the tray to provide the assembled condition of FIG. 1. As shown in FIG. 2, tray 10 has a rectangular body defined by a pair of opposite sides 30, a rear wall 32, and a bottom wall 34, all of which cooperate to bound a storage area generally designated 36. Another essential structural feature of the tray 10, particularly with respect to the previously noted rear compartments 12 and the front shallow compartments 14, is a middle wall 40 which is connected in spanning relation between the opposite sides 30 and which divides the storage area 36 into a front storage area generally designated 42, and a rear storage area generally designated 44. From the description thus far provided, it should be readily appreciated that the previously noted front compartments 14 are areas delineated in the front storage area 42, and that the rear compartments 12 are areas delineated in the rear storage area 44.

Referring first to how the front area 42 is delineated into smaller sized compartments, it will be noted that in its vertical dimension this area is subdivided by a horizontally oriented bottom wall 46 which itself is in a clearance position above the main tray bottom wall 34. In this way, storage space above the wall 46 is used for the shallow storage compartments 14, whereas the space below wall 46 which exists between this wall and the bottom wall 34 is used in accommodating the previously noted drawers 16 and in forming the open compartments 18 and 20.

It is convenient, however, first to describe the more simpler construction embodied in the tray 10 to provide the previously noted deeper rear compartments 12. Thus, still referring to FIG. 2, but this time in conjunction with FIG. 3, it will be noted that on the rear surface 40A of the middle wall 40, which is in facing relation to the inner surface 32A of the rear wall 32, that there are spaced pairs of projections, individually and collectively designated 48, that are in aligned relation with each other. Thus, using as an example the end compartments specifically designated 12A in FIG. 3, this compartment is formed using a dividing panel, individually and collectively designated 50, which is seated in the vertical slot 48A that is provided by the selected pairs of projections 48 for locating the panel 50 and thereby providing the desired dimension and shape to the compartment 12A. It, of course, should be readily appreciated that by appropriate selection of the aligned projections 48 different dimensions and shapes can be provided to the rear compartments 12, as exemplified by the somewhat smaller compartments specifically designated 12B and 12C in FIG. 3. Also, delineating of the rear storage space 44 is not limited to the use of plain divider panels 50, but that use can be also made of a combination of intersecting panels as exemplified by the configuration 52.

Figure 3:
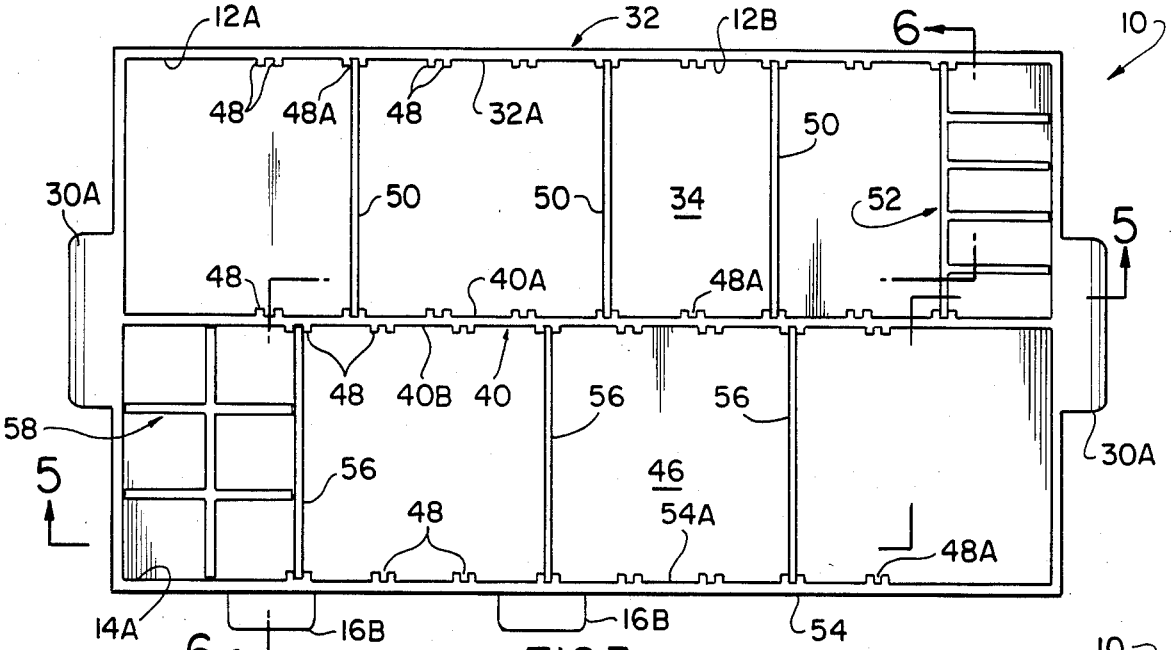
FIG. 3 is a plan view of the tray.
Figure 4:
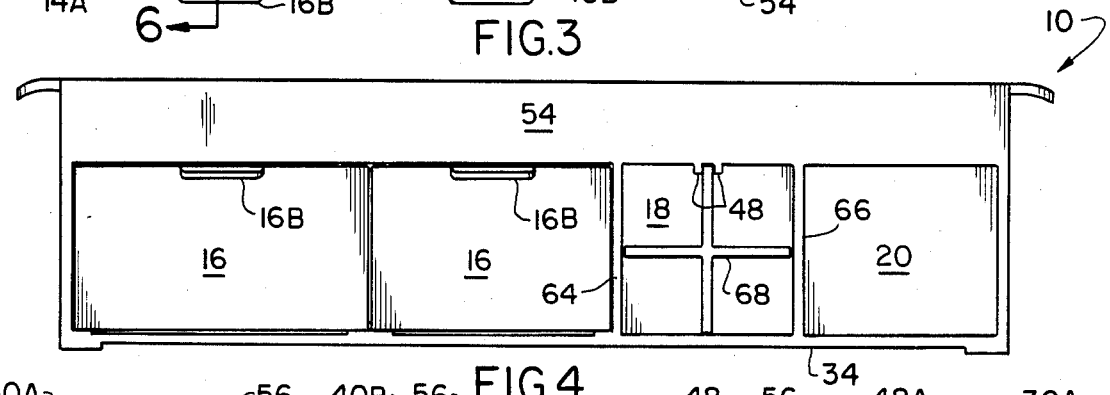
FIG. 4 is a front elevational view of the tray.
Figure 5:
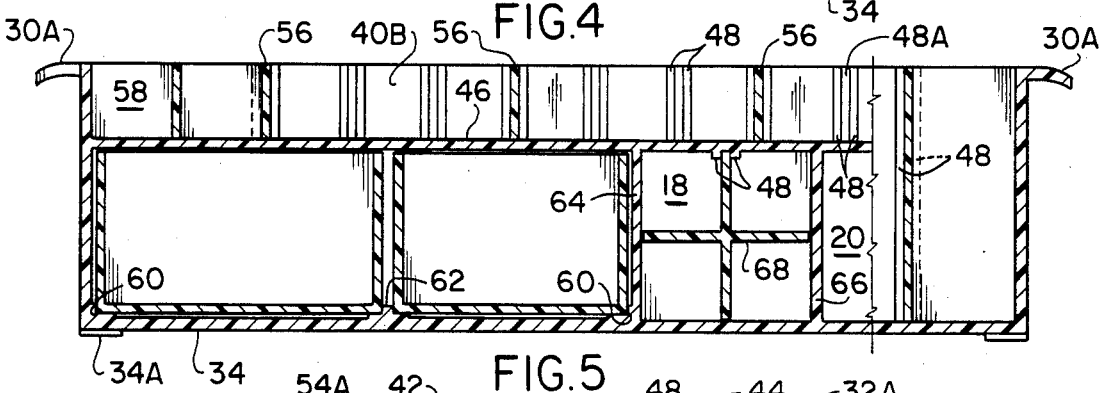
FIG. 5 is a front elevational view, in section, taken along line 5—5 of FIG. 3, showing further structural details.
Figure 6:
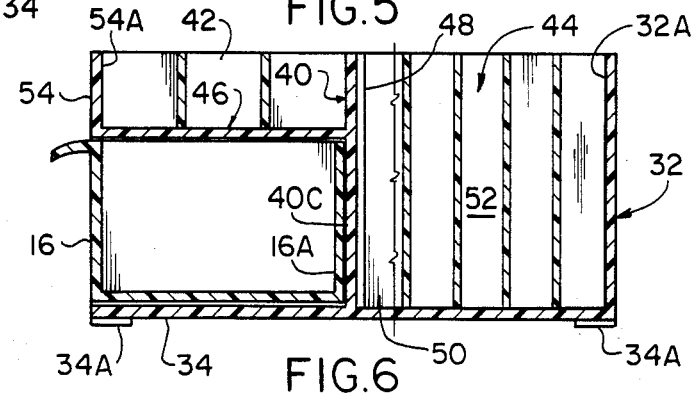
FIG. 6 is also a sectional view, but taken along line 6—6 of FIG. 3, showing in particular a middle wall which divides the tray into front and rear sections.

Returning now to the delineation of the front storage area 42, reference should be continued to be made to FIG. 2, and also in conjunction with the remaining figures, and in particular to FIG. 6. On the opposite surface 40B of the middle wall 40, and thus in facing relation to an upper partial front wall 54 which is connected in spanning relation between the opposite sides 30, and more particularly on the inner surface 54A of said wall 54, there are similarly provided spaced pairs of projections 48 in aligned relation with each other which are also used in the manner already described for the seating of dividing panels, individually and collectively designated 56, for subdividing the front storage area 42 into the shallow smaller sized compartments 14. The end compartment, more particularly designated 14A in FIG. 3, is advantageously subdivided into smaller areas by transversely oriented panels in the shape and criss-crossing configuration noted by the reference numeral 58.

Thus, the area used for the shallow storage compartments 14 is that bouded by the bottom wall 46, by the front portions of the opposite sides 30, and by the upper portion of the middle wall 40 and the partial front wall 54. It is convenient to note at this point that to provide the rear compartments 12 with greater depth, tray 10 uses the entire height of the middle wall 40, rear wall 32 and rear portions of the opposite sides 30, as well as, of course, the rear portion of the bottom wall 34, to bound said rear storage space 44.

To utilize to advantage the available space in the front of the tray 10 beneath the wall 46, there is provided a corner construction 60 and a guiding ridge or projection 62 which guides the previously noted drawers 16 in sliding movement between open positions extending from the tray 20, and, therefore, forward to the front wall 54, and closed positions, in which the drawers, and more particularly the rear walls 16A thereof are in abutting relation against the rear lower portion 40C of the middle wall 40. Thus, an important functioning of the middle wall portion 40C is as a stop for the inward sliding movement of the drawers 16, all as is best illustrated in the cross sectional view of FIG. 6 to which figure reference should be made.

Completing the construction of the right side of the tray 10 are walls 64 and 66 which, for structural reasons, are permanently embodied in the construction, rather than being optionally removable in the manner of the previously noted divider panels 50, 56. The storage areas provided by the walls 64 and 66 can optionally be further subdivided as exemplified by the criss-cross panel configuration 68, or left empty to provide the compartment 20, For completeness' sake, it is noted that in a preferred embodiment, that at the four corners of the bottom wall 34, there are provided narrow legs, individually and collectively designated 34A, that the drawers 16 are provided with laterally extending grips 16B, and that to contribute to the portability of the tray 10, there are provided laterally extending grips 30A on the tray opposite sides 30.

From the foregoing description it should be readily appreciated that despite the simple and compact construction of the tray 10, that it affords not only a great number of storage compartments, but that these compartments are of various dimensions and shapes and are, therefore, correspondingly capable of accommodating cosmetic items and sundries of various shapes and sizes. Although the embodiment illustrated and described is preferred, a latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention. herein.

What is claimed is:

1. An open compartmentalized tray for storing various sized cosmetic sundries and the like comprising a body for the tray defined by a pair of opposite sides, a tray bottom wall, a front piece, and a rear wall, all cooperating to bound a storage area, a middle wall arranged in spanning relation between said opposite sides delineating said storage area into a front section and a rear section, said rear section above the rear portion of the tray bottom wall being bounded by the rearward portions of said opposite sides, said rear wall and said middle wall and all being of a selected height for forming a rear storage compartment for larger sized objects, a horizontally oriented compartment bottom wall disposed in said front section attached intermediate the height of and in spanning relation between said opposite sides and extending forwardly of said middle wall forming a front storage compartment in a clearance position above the front portion of the tray bottom wall for smaller sized objects, plural drawers disposed beneath said front storage compartment for sliding movement between open positions extended from the tray and closed positions in abutment against the bottom portion of said middle wall, a first array of spaced pairs of plural projections disposed in aligned facing relation on said rear wall and on one side of said middle wall for the full height of the last two mentioned walls, each of said pairs of plural projections of said first array defining a groove therebetween, and a second array of spaced pairs of plural projections disposed in aligned facing relation on said other side of said middle wall and confronting face of said front piece for the height of the last-mentioned side and face above said compartment bottom wall, each of said pairs of plural projections of said second array defining a groove therebetween, and plural panels sized to be disposed in said grooves of said first and second array for delineating storage compartments on opposite sides of said middle wall whereby the tray has compartments and drawers for storing different sized objects.

2. A storage tray for cosmetics and the like as claimed in claim 1, wherein selected ones of said panels are of criss-cross configurations to further subdivide the storage space of said storage compartments.

* * * * *